US008333312B2

(12) United States Patent
Dickner et al.

(10) Patent No.: US 8,333,312 B2
(45) Date of Patent: Dec. 18, 2012

(54) METHOD AND ASSEMBLY FOR SEPARATING OPENING DEVICES SUPPLIED JOINTLY IN THE FORM OF A SHEET AND APPLIED INDIVIDUALLY TO RESPECTIVE PACKAGES OF POURABLE FOOD PRODUCTS

(75) Inventors: Jonas Dickner, Helsingborg (SE); Inge Nilsson, Uddevalla (SE); Stefan Bokander, Marieholm (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 730 days.

(21) Appl. No.: 12/160,582

(22) PCT Filed: Dec. 29, 2006

(86) PCT No.: PCT/EP2006/070281

§ 371 (c)(1),
(2), (4) Date: Jul. 10, 2008

(87) PCT Pub. No.: WO2007/080061

PCT Pub. Date: Jul. 19, 2007

(65) Prior Publication Data

US 2010/0154358 A1 Jun. 24, 2010

(30) Foreign Application Priority Data

Jan. 13, 2006 (EP) ..... 06100350

(51) Int. Cl.

| | |
|---|---|
| ***B26D 9/00*** | (2006.01) |
| ***B65B 61/00*** | (2006.01) |
| ***B65B 61/06*** | (2006.01) |

(52) U.S. Cl. ..... 225/4; 83/13; 83/39; 53/412; 53/128.1; 53/393

(58) Field of Classification Search ..... 225/4; 83/39, 83/408, 946, 35, 49, 945, 217, 218, 248, 83/255, 277, 932; 493/62, 354, 61, 342, 493/339, 340; 53/412, 128.1, 393
See application file for complete search history.

(56) References Cited

U.S. PATENT DOCUMENTS

| | | | | |
|---|---|---|---|---|
| 3,224,306 | A * | 12/1965 | Hawley et al. | 83/23 |
| 3,759,122 | A * | 9/1973 | Lane et al. | 83/24 |
| 3,818,790 | A * | 6/1974 | Culp et al. | 83/408 |
| 3,888,066 | A | 6/1975 | Tabur | |
| 3,915,039 | A * | 10/1975 | Schoppee | 83/864 |

(Continued)

OTHER PUBLICATIONS

Form PCT/ISA/210 (International Search Report) dated Mar. 27, 2007.

(Continued)

*Primary Examiner* — Ghassem Alie
(74) *Attorney, Agent, or Firm* — Buchanan Ingersoll & Rooney PC

(57) ABSTRACT

A method of separating opening devices supplied jointly in the form of a sheet and applied individually to respective packages of pourable food products involves feeding the sheet, which has a number of parallel rows of opening devices integral with one another, to a first station where a first row is detached from the rest of the sheet. The first row is fed to a second station where it is divided into individual opening devices, and a following second row of the sheet is fed to the first station as the preceding first row is being fed to the second station and/or is being at least partly divided.

33 Claims, 4 Drawing Sheets

U.S. PATENT DOCUMENTS

| | | | | |
|---|---|---|---|---|
| 4,253,364 | A * | 3/1981 | Kiefer et al. | 83/217 |
| 5,121,588 | A | 6/1992 | Abate | |
| 5,397,106 | A * | 3/1995 | Hill | 270/58.34 |
| 2001/0001373 | A1 * | 5/2001 | Schreiber et al. | 83/23 |
| 2005/0252351 | A1 | 11/2005 | Natterer | |

OTHER PUBLICATIONS

Form PCT/ISA/237 (Written Opinion of the International Searching Authority) dated Mar. 27, 2007.

* cited by examiner

METHOD AND ASSEMBLY FOR SEPARATING OPENING DEVICES SUPPLIED JOINTLY IN THE FORM OF A SHEET AND APPLIED INDIVIDUALLY TO RESPECTIVE PACKAGES OF POURABLE FOOD PRODUCTS

TECHNICAL FIELD

The present invention relates to a method of separating opening devices supplied jointly in the form of a sheet and applied individually to respective packages of pourable food products.

BACKGROUND ART

As is known, many pourable food products, such as fruit juice, UHT (ultra-high-temperature treated) milk, wine, tomato sauce, etc., are sold in packages made from sterilized packaging material on fully automatic packaging machines. The packaging material may, for example, be web-fed and folded and sealed longitudinally to form a continuous vertical tube. The tube is then filled with the sterilized or sterile-processed food product, and is sealed and cut along equally spaced cross sections to form pillow packs, which are then folded mechanically to form the finished, e.g. parallelepiped-shaped, packages.

Instead of being formed into a continuous tube, the packaging material may be cut into blanks, which are formed into the finished packages on forming spindles, and the packages then filled with the food product and sealed.

Once the packages are formed, an opening device, by which to pour out the food product, is applied to a top wall of each package. The opening devices are closable to protect the food product from contact with external agents, and, in their most commonly marketed form, comprise an annular portion defining a pour opening and fixed about a removable or pierceable portion of the top wall; and a cap hinged to the annular portion and which is removable to open the package.

Opening devices of the above type are produced in the form of plastic sheets defining a matrix of opening devices, i.e. a number of parallel rows of opening devices joined integrally by break-off connecting tabs by which to separate the opening devices.

A need is felt for a method of separating the opening devices in such a way as to permit orderly, continuous, efficient, fast supply of the individual opening devices to a follow-up station where they are applied to the top walls of the respective packages.

In particular, a need is felt to separate the opening devices using relatively fast-moving parts involving a relatively small amount of travel, and/or using a relatively small number of parts and/or parts having a bulk as small as possible.

DISCLOSURE OF INVENTION

It is an object of the present invention to provide a method of separating opening devices, supplied jointly in the form of a sheet and applied individually to respective packages of pourable food products, designed to meet the above requirements cheaply and easily.

According to the present invention, there is provided a method of separating opening devices supplied jointly in the form of a sheet and applied individually to respective packages of pourable food products; said sheet comprising a number of parallel rows of opening devices integral with one another; and the method being characterized by comprising the steps of:

- feeding a first row of said sheet to a first separating station;
- detaching said first row from the rest of said sheet at said first station;
- feeding said first row to a second separating station;
- dividing said first row into individual opening devices at said second station;
- feeding a following second row of said sheet to said first station, as the preceding first row is being fed to the second station and/or is being at least partly divided.

The present invention also relates to an assembly for separating opening devices, supplied jointly in the form of a sheet and applied individually to respective packages of pourable food products, in accordance with the method as previously described; said sheet comprising a number of parallel rows of opening devices integral with one another; and the assembly being characterized by comprising:

- first separating means for separating said rows successively from the rest of said sheet;
- conveying means for feeding a first row of said sheet to said first separating means;
- second separating means for dividing said first row into individual opening devices;
- feed means for feeding said first row to said second separating means;
- control means for feeding a following second row of said sheet to said first separating means, as the detached preceding first row is being fed to said second separating means and/or is being at least partly divided by said second separating means.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Number 1 in the accompanying drawings indicates as a whole an assembly for separating opening devices 2, which are supplied jointly in the form of a sheet 3 of plastic material, and which are eventually applied individually to respective packages (not shown) of pourable food products.

Figure 3:
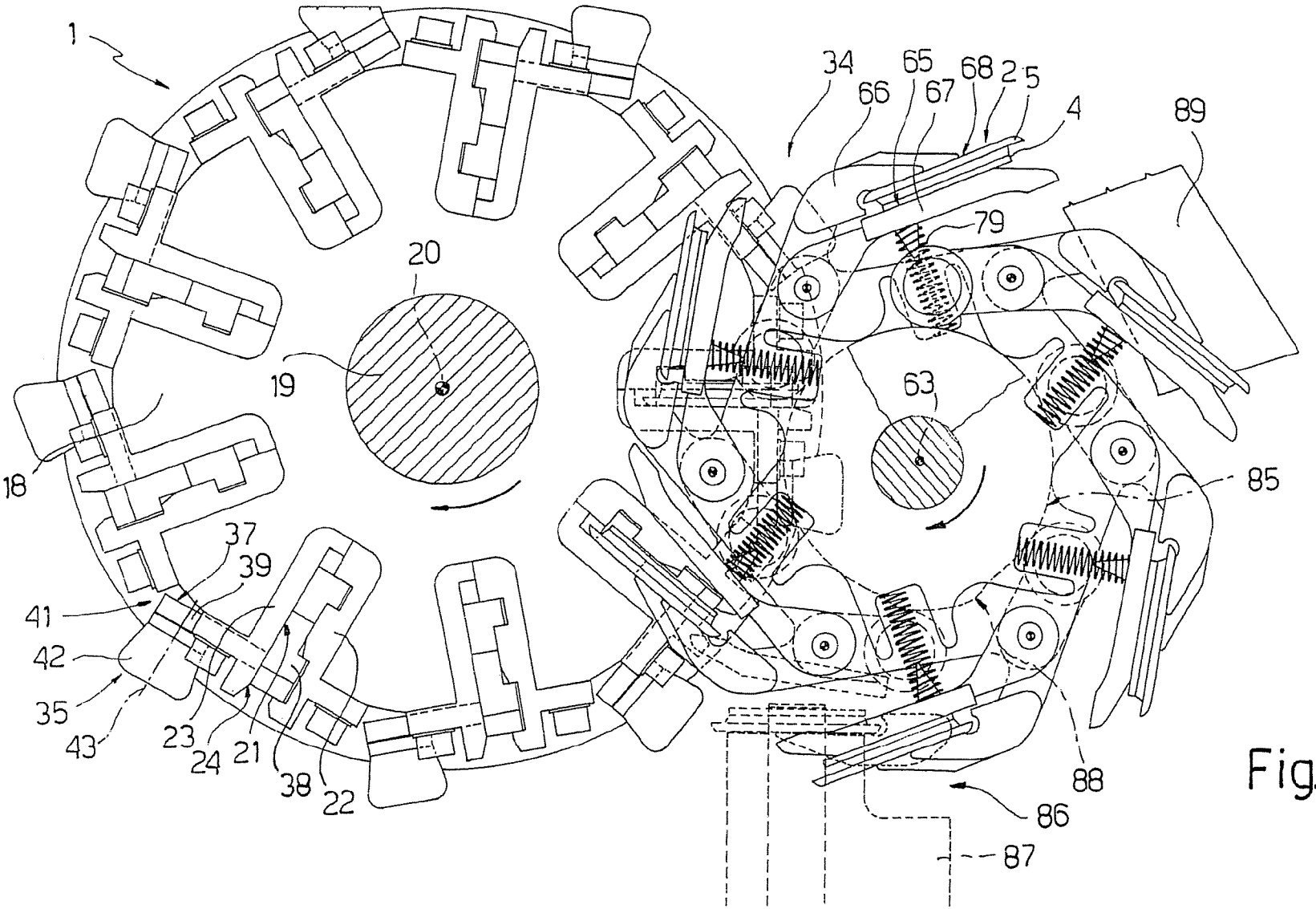
FIG. 3 shows a partly sectioned side view of two component parts of the FIGS. 1 and 2 assembly.

With reference to FIG. 3, each device 2 comprises a bottom annular frame 4, which defines a pour opening (not shown), is applied about a removable or pierceable portion of a top wall of a package, and is fitted with a top cap 5 connected to frame 4 by a virtual hinge.

Figure 1:
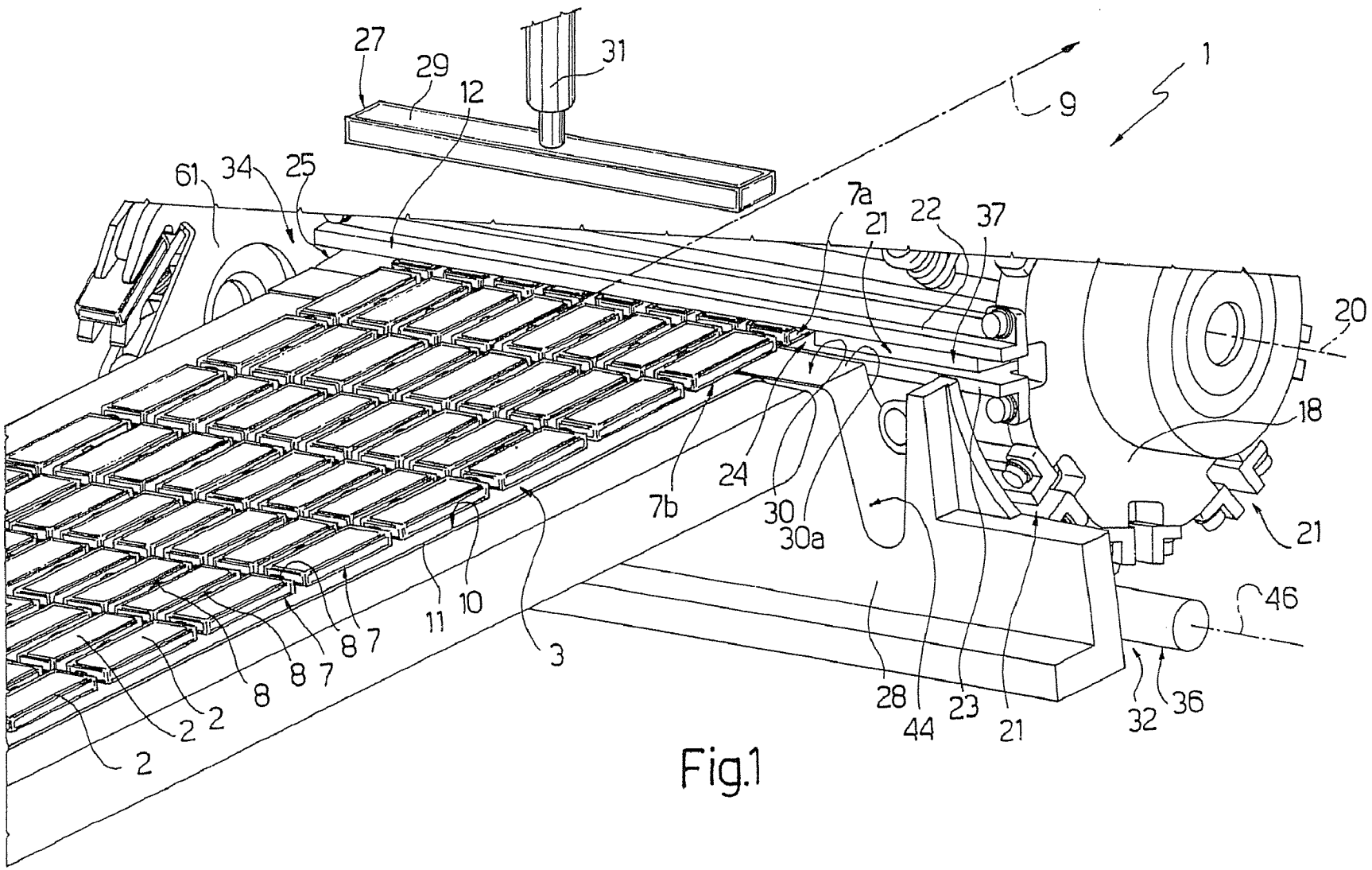
FIGS. 1 and 2 show views in perspective, with parts removed for clarity, of a preferred embodiment of an assembly for separating opening devices, supplied jointly in the form of a sheet and applied individually to respective packages of pourable food products, in accordance with the method of the present invention.

As shown in FIG. 1, sheet 3 defines a matrix of devices 2, i.e. comprises a number of parallel rows 7 of devices 2 joined integrally by connecting tabs 8, and is fed in a longitudinal direction 9 to a separating station 12 on a horizontal surface 10 by a powered belt 11 or other type of conveyor.

At station 12, rows 7 are separated successively by a drum 18, which is hinged to a fixed supporting shaft 19 (FIG. 3) to rotate about a respective horizontal axis 20 perpendicular to direction 9, is axially fixed, and has a number of peripheral radial slots 21 equally spaced angularly and parallel to axis 20.

Drum 18 is powered, in a manner not shown in detail, to rotate one-way in steps and successively align slots 21, at station 12, with the incoming sheet 3 on belt 11. Slots 21 are of such a radial depth as to receive one row 7*a* at a time, i.e. the first row at the end of sheet 3 in direction 9, are defined by respective pairs of opposite walls 22, 23 fixed to drum 18, and are open both radially outwards and laterally at least one end. The radial opening of each slot 21 defines an inlet 24 for row 7*a*, while the lateral opening defines an outlet 25 for the preceding row 7*a* detached from the following adjacent row indicated 7*b*.

Row 7*a* is detached by rotating drum 18 one step and then moving row 7*a* with respect to row 7*b*, while row 7*b* is retained by a retaining device 27. Device 27 is interposed between drum 18 and belt 11, and comprises a fixed bottom structure 28 and a vertically mobile top plate 29 positioned facing each other and elongated horizontally in a direction perpendicular to direction 9. Structure 28 has a flat top surface 30 defining an extension of surface 10 at the end of belt 11; and plate 29 is operated from above by an actuator 31 (shown partly), e.g. a pneumatic cylinder, to translate to and from a lowered retention position, in which it clamps row 7*b* on surface 30 as row 7*a* is being detached.

More specifically, at station 12, wall 22 defines the top of slot 21 and, as it rotates downwards crosswise to surface 30, cooperates with an edge 30*a* of surface 30 to tear or cut the plastic tabs 8 connecting rows 7*a* and 7*b*. Walls 22, 23 are also spaced apart circumferentially by a distance calibrated to retain row 7*a* between them once it is detached.

Figure 2:
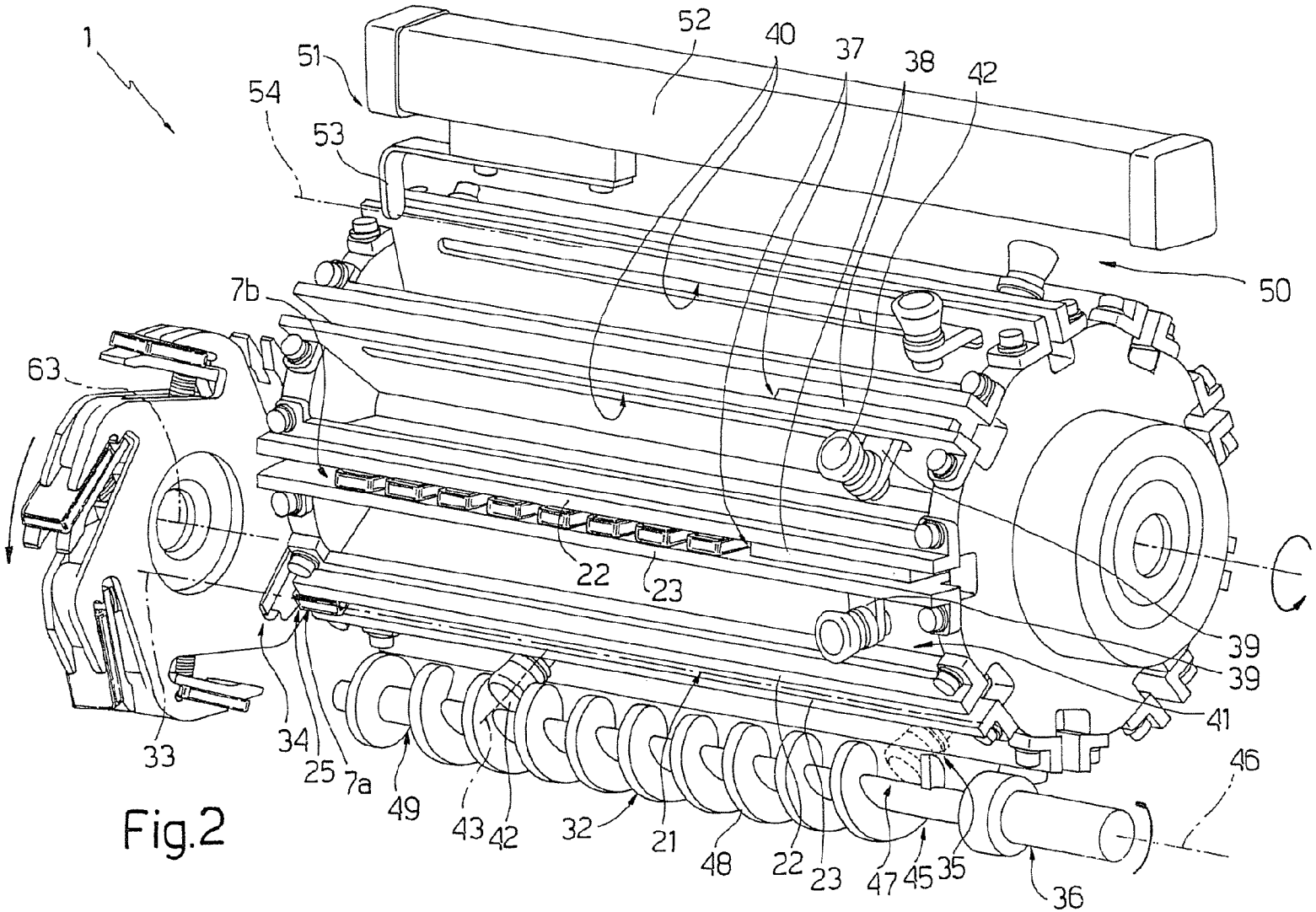

With reference to FIG. 2, one-step rotation of the drum from station 12 brings row 7*a* to a feed station 32, where it is fed in a straight direction 33 through outlet 25 of relative slot 21 to a further separating station 34. As it travels in direction 33, row 7*a* is guided by walls 22, 23 of the slot 21 housing it, and is fed forward by a device 35 comprising a conveying unit 36 common to all of slots 21, and a pusher 37 for each slot 21.

Pusher 37 comprises a plate 38 housed inside slot 21 to slide to and from outlet 25; and a transmission arm 39, which is fixed to one face of plate 38, in a manner not described in detail, extends tangentially with respect to axis 20 through a slit 40 in wall 23, and projects inside a cavity 41 defined by wall 23 and wall 22 of the adjacent slot 21. The free end of arm 39 is fitted with a hinged roller 42 projecting outwards of cavity 41 and rotating idly about a respective axis 43 perpendicular to arm 39 and to axis 20. Structure 28 has a recess 44 (FIG. 1) alongside surface 30 to prevent interference with rollers 42.

Unit 36 is housed in station 32, and comprises a worm 45 fitted to structure 28 and powered, in a manner not shown, to rotate one-way in steps about a respective axis 46 parallel to axis 20. Worm 45 comprises a tangential inlet 47 engaged by roller 42 of the incoming pusher 37 to station 32; a helical feed portion 48 which, as it rotates about axis 46, feeds said roller 42 and, therefore, row 7*a* to station 34; and a tangential outlet 49 which allows the drawn-forward roller 42 to continue rotating in steps about axis 20.

A backup station 50, spaced angularly apart from station 32 about drum 18, is provided to translate pushers 37 back along respective slots 21, in the opposite direction to outlets 25, to a start position. Station 50 houses an actuating unit 51, which is common to all of slots 21, is separate from unit 36, and comprises an actuator 52, e.g. a pneumatic cylinder, and a draw finger 53. Finger 53 extends radially towards axis 20 in such a position as to rest against roller 42 of the incoming pusher 37 to station 50, and is activated by actuator 52 to translate, in a direction 54 parallel to axis 20, between a first position adjacent to outlets 25, and a second position (not shown) adjacent to the start position of pushers 37.

Figure 4:
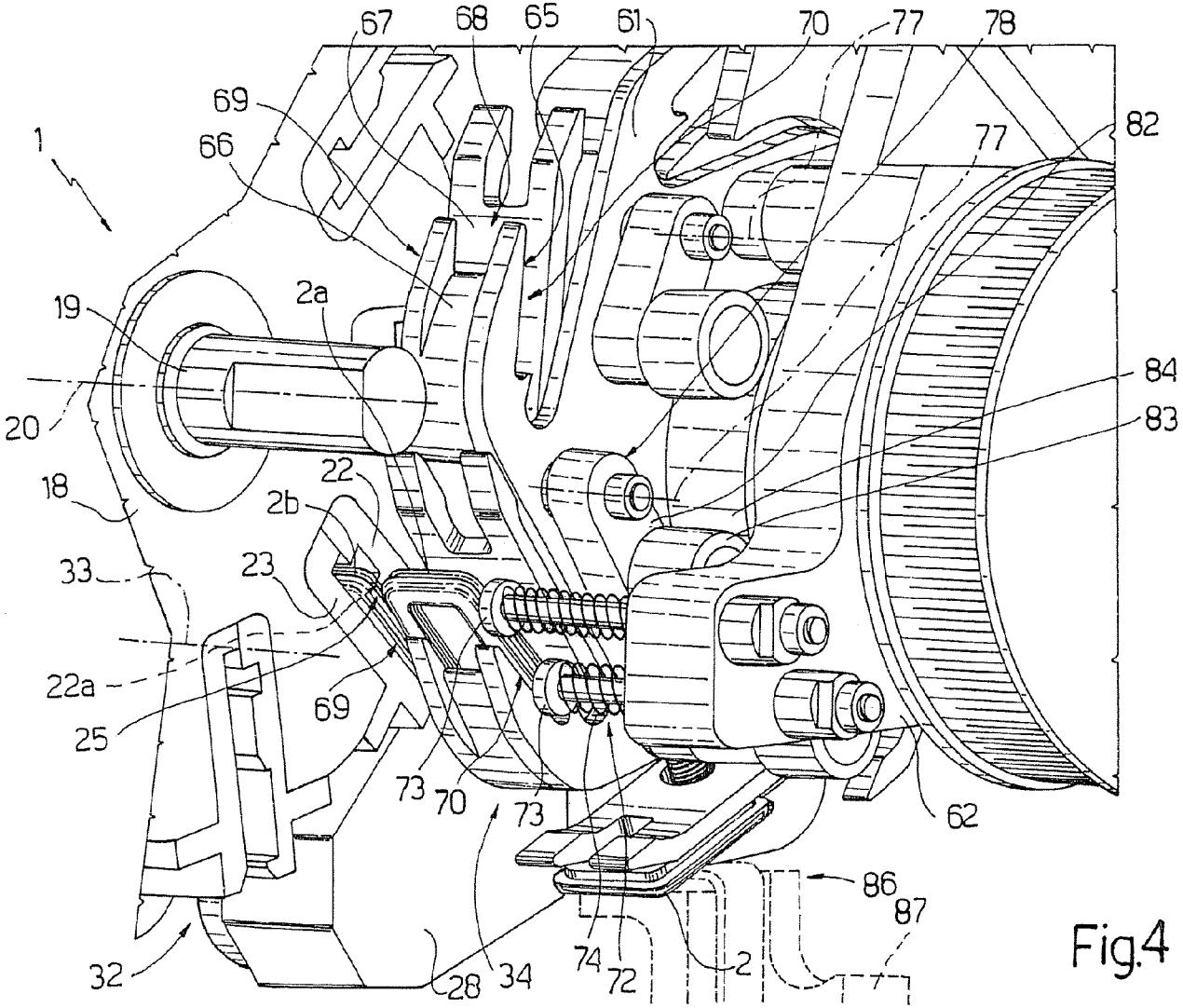
FIG. 4 shows a larger-scale different view in perspective of a detail of the FIGS. 1 and 2 assembly.

With reference to FIGS. 3 and 4, at station 34, row 7*a* is divided into individual devices 2. More specifically, devices 2 are detached successively by a disk 61 located axially adjacent to drum 18 and hinged to a fixed supporting structure 62 about a respective horizontal axis 63 parallel to axis 20. Disk 61 has a number of peripheral, angularly equally spaced seats 65, and is powered, in a manner not shown in detail, to rotate one-way in steps about axis 63 to feed seats 65 successively into station 34. On reaching station 34, seats 65 mate with outlet 25, through which row 7*a* comes out, and are sized so that each receives one opening device at a time, i.e. the currently first device 2*a* at the end of row 7*a*.

Each seat 65 is defined by two radially facing jaws 66, 67, and so comprises a substantially tangential opening 68 facing in the rotation direction of disk 61, and two lateral openings 69, 70 facing each other in direction parallel to axis 63.

Once device 2*a* is fed into relative seat 65 through opening 69, it is detached from the following adjacent device 2*b* by rotating disk 61 one step, while device 2*b* is retained by walls 22, 23 in a direction tangential to axis 63. More specifically, in station 34, jaw 66 defines the bottom of seat 65 receiving device 2*a*, and, as it rotates upwards crosswise to walls 22, 23, cooperates with a top edge 22*a* of outlet 25 (FIG. 4) to tear or cut the plastic tabs 8 connecting devices 2*a*, 2*b*.

With reference to FIG. 4, station 34 houses a stop device 72 located immediately downstream from disk 61 in the travelling direction of row 7*a*, and defining a stop, in direction 33, for device 2*a* which tends to project through opening 70. Device 72 comprises two side by side plates 73 fitted to structure 62, and which are slid by device 2*a* in direction 33 in opposition to the elastic action of respective shock-absorbing springs 74.

Jaws 66 are radially outer and fixed to disk 61 in a manner not described in detail, while jaws 67 are radially inner and hinged to disk 61 about respective oscillation axes 77 parallel to axis 63. Jaws 67 define the arms of respective rocker arms 78, which rotate, in opposition to respective springs 79 (FIG. 3) interposed between jaws 67 and disk 61, from a closed position retaining devices 2 inside respective seats 65, to an open position allowing devices 2 into/out of seats 65.

With reference to FIG. 4, the other arms of rocker arms 78, opposite jaws 67 and indicated 82, are located on an axial side of disk 61, and are fitted on the end with respective tappets 83 defined by rollers which roll along a disk-shaped cam 84 (shown by the dash line in FIG. 3). Cam 84 is fixed to structure 62 in a manner not described in detail, is adjacent to and coaxial with disk 61, and comprises a circular portion 85 which keeps jaws 67 closed as they rotate from station 34 to a transfer station 86 where devices 2 are released to a conveyor 87 (shown partly by a dash line in FIG. 3 and not described in detail). Cam 84 also comprises a contoured portion 88 connected to portion 85 and which opens jaws 67 on entering station 86.

A guide member 89 (shown partly in FIG. 3) is provided along the periphery of disk 61 to set devices 2 to a predetermined position inside respective seats 65. Member 89 is funnel-shaped, i.e. is wider at the inlet than at the outlet, and defines a fixed guide for gradually diverting the edges of any ill-positioned devices 2, as devices 2 are rotated about axis 63 towards station 86.

During operation of assembly 1 in FIGS. 1 and 2, sheet 3 is fed towards station 12 until a fixed sensor (not shown), fitted to shaft 19, supplies a central control unit (not shown) with a consent signal indicating row 7*a* is fully inserted inside the stationary slot 21 at station 12. At this point, the central control unit operates actuator 31 to lower plate 29 to clamp row 7*b* on surface 30, and, immediately after, commands a one-step rotation of drum 18 to detach row 7*a* by moving row 7*a* with respect to the rest of sheet 3. Rotation of the drum to detach row 7*a* obviously defines a first portion of the travel necessary to move row 7*a* to station 34.

Roller 42 of pusher 37 corresponding to row 7*a* automatically engages worm 45 through inlet 47 as the drum rotates towards station 32, and is drawn in steps by portion 48 in direction 33 to push row 7*a* towards station 34. At the same time, the central control unit raises plate 29, so that the next row 7*b* is fed into the next empty slot 21, by now at station 12, as the preceding row 7*a* is being fed towards station 34 and/or is being at least partly divided into individual devices 2.

Worm 45 is powered to feed row 7*a* forward in steps equal to the size or spacing of devices 2 in direction 33, and synchronously with or as a function of step rotation of disk 61. More specifically, row 7*a* is pushed in direction 33 when disk 61 is stationary with an open seat 65 available at station 34.

At the start of each rotation step of disk 61, the incoming device 2*a* at station 34 is detached from the rest of row 7*a*, and, at the same time, is closed inside relative seat 65 by jaw 67 oscillating with respect to disk 61. Oscillation of the jaw is produced by the thrust exerted by spring 79 to drop tappet 83 from portion 88 onto portion 85. At the end of each rotation step of disk 61, another open seat 65 is available at station 34 to receive the next device 2*b*, which is again detached as described above.

Devices 2 are then transferred by disk 61, individually, one after the other, and in steps, about axis 63 to station 86, and, as they are rotated, are automatically oriented one after the other by member 89.

Detachment of the next row 7*b* from the rest of sheet 3, by further one-step rotation of drum 18, is only commanded when the preceding row 7*a* has been completely divided up, and the slot 21 located at station 32 is completely clear. For example, detachment of row 7*b* is commanded in response to a consent signal supplied by a counter for counting the individually detached devices 2, in addition to the consent signal supplied by the sensor on shaft 19.

When drum 18 is rotated another step, roller 42 of pusher 37 at the end of its travel at station 32 disengages worm 45 through outlet 49 and, at the same time, roller 42 of the next pusher 37 engages inlet 47 and is then drawn along by portion 48. A few rotation steps of drum 18 brings pushers 37, one after the other, to station 50 where they are backed up into the start position along respective slots 21.

The method described above therefore provides for dividing sheet 3 into individual devices 2 quickly, efficiently, and by means of a highly compact assembly 1. These advantages are mainly due to each row 7 being ready for detachment from the rest of sheet 3 by the time the preceding row has been completely divided into individual devices 2; to tabs 8 being broken by moving rows 7 and devices 2 with respect to one another, as opposed to using additional moving cutters; to the movement by which each row 7 is detached in itself defining part of the transfer movement to station 34; to the detaching members (defined by drum 18 and disk 61) and worm 45 rotating one-way, as opposed to back and forth; to slots 21 being designed to transfer rows 7 directly to station 34, with no additional intermediate conveyors required between drum 18 and disk 61; and to the relatively short travel of drum 18 and disk 61 to detach the individual rows 7 and individual devices 2. Moreover, dividing rows 7 successively, as opposed to jointly, into individual devices 2 greatly reduces the "gaps" in release of the individual devices 2 to conveyor 87. Other advantages of the method and assembly 1 are obvious from the foregoing description and attached drawings.

Clearly, changes may be made to the method implemented by assembly 1 without, however, departing from the scope of the present invention, as defined in the accompanying Claims. Row/sheet and opening device/row detachment may be performed otherwise than as described: for example, at least one component of the relative movement detaching the row from the sheet and the opening device from the row may be performed by the rest of sheet 3 (e.g. by means of device 27) and by the rest of row 7 (e.g. by means of drum 18) respectively; and/or even only one of stations 12, 34 may be designed for detachment by relative movement; and/or the relative movement detaching the row from the sheet may have at least one rotation component about an axis parallel to direction 9; and/or axis 63 may be crosswise to axis 20; and/or the relative movement detaching the row from the sheet and the opening device from the row may have at least one bending component along lines through connecting tabs 8.

The invention claimed is:

1. A method of separating opening devices supplied jointly in a sheet form and applied individually to respective packages of pourable food products; said sheet comprising a number of parallel rows of opening devices integral with one another including immediately successive first and second rows of the opening devices; and the method comprising:

feeding the first row of the opening devices of said sheet to a first separating station;

detaching said first row of opening devices from a remainder of said sheet at said first station;

feeding said first row of opening devices to a second separating station;

dividing said first row of opening devices into individual opening devices at said second station;

feeding the immediately successive second row of opening devices of said sheet to said first station after the first row of opening devices has been completely detached from the second row of opening devices and as the first row is being fed to the second station and/or is being at least partly divided.

2. A method as claimed in claim 1, comprising detaching said second row of opening devices from the remainder of said sheet at said first station when said first row of opening devices has been completely divided.

3. A method as claimed in claim 1, wherein each row of opening devices is detached by moving each respective row with respect to the remainder of said sheet.

4. A method as claimed in claim 3, wherein the movement performed to detach each respective row from the remainder of said sheet defines a first portion of travel of said respective row to said second station.

5. A method as claimed in claim 3, wherein each respective row of opening devices is detached by moving said respective row in a direction crosswise to a conveying surface on which said sheet is supplied.

6. A method as claimed in claim 5, wherein each respective row of opening devices is detached by rotating said respective row in one rotation direction about a first axis parallel to said respective row.

7. A method as claimed in claim 6, wherein said rotation is performed in steps to successively feed into said first station a number of straight first seats equally spaced about said first axis and each for receiving a relative row of said sheet.

8. A method as claimed in claim 1, wherein each respective row of opening devices is divided into individual opening devices by successively detaching the opening devices as said respective row is fed to the second station.

9. A method as claimed in claim 8, wherein each respective opening device is detached by moving said respective opening device with respect to a remainder of the opening devices of said respective row.

10. A method as claimed in claim 9, wherein each respective opening device is detached by moving said respective opening device in a direction crosswise to a feed surface along which said row of opening devices is fed.

11. A method as claimed in claim 10, wherein each respective opening device is detached by rotating said respective opening device in one rotation direction about a second axis.

12. A method as claimed in claim 11, wherein said rotation successively feeds into said second station a number of second seats equally spaced about said second axis and each for receiving a relative opening device of said row.

13. A method as claimed in claim 11, comprising orienting each said respective opening device in a predetermined position, after it is detached from the remainder of said row and as it is rotated to a transfer station.

14. An assembly for separating opening devices, supplied jointly in sheet form and applied individually to respective packages of pourable food products, in accordance with the method as claimed in claim 1; said sheet comprising a number of parallel rows of opening devices integral with one another; and the assembly comprising:

first separating means for separating said rows of opening devices successively from a remainder of said sheet;

conveying means for feeding a first row of opening devices of said sheet to said first separating means;

second separating means for dividing said first row of opening devices into individual opening devices;

feed means for feeding said first row of opening devices to said second separating means;

control means for feeding a following second row of opening devices of said sheet to said first separating means, as the first row of opening devices detached from said sheet is being fed to said second separating means and/or is being at least partly divided by said second separating means.

15. An assembly as claimed in claim 14, comprising control means for controlling said first separating means to detach said second row of opening devices from the remainder of said sheet when said first row has been completely divided by said second separating means.

16. An assembly as claimed in claim 14, wherein said first separating means comprise at least one first seat for receiving one of said rows of opening devices, and which is movable to move said one row with respect to the remainder of said sheet.

17. An assembly as claimed in claim 16, wherein said first seat is movable crosswise to a conveying surface on which said sheet is supplied.

18. An assembly as claimed in claim 17, wherein said first seat rotates one-way about a first axis parallel, in use, to said rows of opening devices.

19. An assembly as claimed in claim 18, wherein said first separating means comprise a powered drum rotating about a respective axis defining said first axis, and having a number of peripheral, equally spaced, straight first seats, each for receiving a respective row of opening devices of said sheet.

20. An assembly as claimed in claim 19, wherein said straight first seats define respective guides for feeding respective said rows in a direction parallel to said first axis.

21. An assembly as claimed in claim 20, wherein said feed means comprise:

a respective pusher, carried by said drum, for each said straight first seat; and actuating means located alongside said drum and common to all said pushers.

22. An assembly as claimed in claim 21, wherein said actuating means comprise a worm powered to rotate one-way about a third axis parallel to said first axis, and which is selectively engaged by draw portions of said pushers.

23. An assembly as claimed in claim 22, comprising reversing means located alongside said drum and for successively backing up said pushers along respective said first seats and in an opposite direction to said second separating means.

24. An assembly as claimed in claim 14, wherein said second separating means comprise at least one second seat for receiving an individual opening device of the first row of opening devices detached from the remainder of said sheet, and which is movable to move said individual opening device with respect to the remainder of said row of opening devices.

25. An assembly as claimed in claim 24, wherein said second seat is movable crosswise to a feed surface along which said row of opening devices is fed.

26. An assembly as claimed in claim 25, wherein said second seat rotates one-way about a second axis.

27. An assembly as claimed in claim 26, wherein said second separating means comprise a powered disk rotating about a respective axis defining said second axis, and having a number of peripheral, equally spaced second seats, each for receiving a relative opening device of said row of opening devices.

28. An assembly as claimed in claim 24, comprising stop means located downstream from said second separating means in a traveling direction of said row of opening devices.

29. An assembly as claimed in claim 26 comprising guide means for orienting each said opening device in the relative second seat into a predetermined position, after the opening device is detached from the remainder of said row and is rotated about said second axis.

30. The method of claim 1, wherein said first row of opening devices is divided into individual opening devices at said second station by detaching each respective opening device, one at a time, from said first row of opening devices.

31. A method of separating opening devices supplied jointly in a sheet form, the opening devices being configured to be applied individually to respective packages of pourable food products, the sheet comprising at least three parallel rows of opening devices including a first row of opening devices and an immediately successive second row of opening devices, each row of opening devices being connected to an adjacent row of the opening devices, and adjacent opening devices in each row being connected to one another, the method comprising:

moving the first row of the opening devices of the sheet to a first separating station;

detaching the first row of opening devices from a remainder of the rows of the opening devices of the sheet at the first station;

moving the first row of opening devices which has been separated from the remainder away from the first separating station and to a second separating station;

dividing the first row of the opening devices into individual opening devices at the second station; and moving the second row of opening devices of the sheet to the first station, the moving of the second row of opening devices to the first station being started after the first row of the opening devices is moved away from the first separating station.

32. The method according to claim 31, wherein the first row of the opening devices and the second row of the opening devices are directly connected to one another by connecting tabs.

33. A method of separating opening devices supplied in a sheet form and applied individually to respective packages of pourable food products; said sheet comprising at least three parallel rows of opening devices, with adjacent opening devices in each row being connected to one another, the at least three parallel rows of connected opening devices comprising a first row of opening devices, an immediately successive second row of opening devices and an immediately successive third row of opening devices, the first row of opening devices being connected to the adjacently positioned second row of opening devices, and the second row of opening devices being connected to the adjacently positioned third row of opening devices; the method comprising:

feeding the first row of the opening devices of the sheet to a first separating station;

detaching the first row of the opening devices from the second and third rows of opening devices at the first separating station;

moving the first row of opening devices to a second separating station;

dividing the first row of opening devices into individual opening devices at the second separating station;

moving the second row of the opening devices to the first separating station after the first row of the opening devices has begun moving to the second separating station;

detaching the second row of the opening devices from the third row of the opening devices at the first separating station;

moving the second row of the opening devices to the second separating station; and dividing the second row of the opening devices into individual opening devices at the second separating station.

* * * * *